US010480506B2

(12) United States Patent
Dmitriev et al.

(10) Patent No.: US 10,480,506 B2
(45) Date of Patent: Nov. 19, 2019

(54) CONICAL SCREW MACHINE WITH ROTATING INNER AND OUTER ELEMENTS THAT ARE LONGITUDINALLY FIXED

(71) Applicant: VERT ROTORS UK LIMITED, Edinburgh (GB)

(72) Inventors: Oleg Dmitriev, Edinburgh (GB); Evgeniy Tabota, Edinburgh (GB)

(73) Assignee: Vert Rotors UK Limited, Edinburgh (GB)

( * ) Notice: Subject to any disclaimer, the term of this patent is extended or adjusted under 35 U.S.C. 154(b) by 85 days.

(21) Appl. No.: 15/120,031

(22) PCT Filed: Feb. 18, 2015

(86) PCT No.: PCT/GB2015/050459
§ 371 (c)(1),
(2) Date: Aug. 18, 2016

(87) PCT Pub. No.: WO2015/124918
PCT Pub. Date: Aug. 27, 2015

(65) Prior Publication Data

US 2017/0227008 A1 Aug. 10, 2017

(30) Foreign Application Priority Data

Feb. 18, 2014 (GB) ..... 1402886.4
Aug. 1, 2014 (GB) ..... 1413716.0

(51) Int. Cl.
*F04C 2/08* (2006.01)
*F04C 15/00* (2006.01)
(Continued)

(52) U.S. Cl.
CPC ..... *F04C 15/0061* (2013.01); *F04C 2/107* (2013.01); *F04C 2/1076* (2013.01);
(Continued)

(58) Field of Classification Search
CPC ..... F04C 15/0061; F04C 29/005
See application file for complete search history.

(56) References Cited

U.S. PATENT DOCUMENTS 1,892,217 A 12/1932 Moineau
2,615,436 A 10/1952 Paul
(Continued)

FOREIGN PATENT DOCUMENTS

BR 102012004953 A2 4/2015
CA 2260634 A1 8/1999
(Continued)

OTHER PUBLICATIONS

International Search Report and Written Opinion for Application No. PCT/GB2015/050459 dated Jun. 26, 2015.
(Continued)

*Primary Examiner* — Mary Davis
(74) *Attorney, Agent, or Firm* — Womble Bond Dickinson (US) LLP

(57) ABSTRACT

A conical screw compressor or pump comprises an inner element configured to rotate around a first axis and an outer element configured to rotate around a second axis. An outer surface of the inner element and an inner surface of the outer element comprise cooperating grooves and teeth that intermesh on rotation. The first axis and the second axis are each stationary and the first axis is inclined relative to the second axis. The inner element and the outer element are configured to be, in operation, synchronously rotated, thereby to reduce or eliminate force exerted by the inner element on the outer element or vice versa.

15 Claims, 6 Drawing Sheets

(51) Int. Cl.
*F04C 2/107* (2006.01)
*F04C 29/00* (2006.01)
*F04C 18/107* (2006.01)

(52) U.S. Cl.
CPC ..... *F04C 18/107* (2013.01); *F04C 29/005* (2013.01); *F04C 2/084* (2013.01); *F04C 2240/20* (2013.01); *F04C 2240/50* (2013.01)

(56) References Cited

U.S. PATENT DOCUMENTS

| | | | | |
|---|---|---|---|---|
| 4,482,305 | A | 11/1984 | Natkai et al. | |
| 4,863,357 | A * | 9/1989 | Olofsson | F01C 1/107 417/356 |
| 6,604,922 | B1 | 8/2003 | Hache | |
| 2003/0228237 | A1 | 12/2003 | Holtzapple et al. | |
| 2009/0226336 | A1 | 9/2009 | Murrow et al. | |
| 2010/0260636 | A1 | 10/2010 | Grann et al. | |
| 2015/0233373 | A1 | 8/2015 | Sicilian | |
| 2015/0247498 | A1 | 9/2015 | Afshari | |

FOREIGN PATENT DOCUMENTS

| | | | |
|---|---|---|---|
| CA | 2265358 | A1 | 9/1999 |
| CA | 2411535 | A1 | 7/2003 |
| CA | 2473282 | A1 | 5/2005 |
| CA | 2532756 | A1 | 7/2006 |
| CA | 2889938 | A1 | 5/2014 |
| CA | 2919886 | A1 | 2/2015 |
| DE | 19758086 | A1 | 7/1999 |
| DE | 102004001817 | A1 | 8/2005 |
| DE | 202006013966 | U1 | 12/2006 |
| DE | 102009010107 | A1 | 8/2010 |
| EP | 935073 | A1 | 8/1999 |
| EP | 1227243 | A2 | 7/2002 |
| EP | 1382853 | A1 | 1/2004 |
| EP | 1406016 | A1 | 4/2004 |
| EP | 1522366 | A1 | 4/2005 |
| EP | 1522729 | A1 | 4/2005 |
| EP | 1813812 | A1 | 8/2007 |
| EP | 1988288 | A1 | 11/2008 |
| EP | 2113667 | A1 | 11/2009 |
| EP | 2453137 | A2 | 5/2012 |
| GB | 722965 | A | 2/1955 |
| GB | 2339598 | A | 2/2000 |
| GB | 2352008 | B | 5/2003 |
| JP | S63212790 | A | 9/1988 |
| JP | 2010001876 | A | 1/2010 |
| NO | 20074795 | | 3/2009 |
| WO | 8706654 | A1 | 11/1987 |
| WO | 200129422 | | 4/2001 |
| WO | 200129423 | | 4/2001 |
| WO | 200367030 | | 8/2003 |
| WO | 200373513 | | 9/2003 |
| WO | 200505836 | | 1/2005 |
| WO | 200578240 | | 8/2005 |
| WO | 200875507 | | 6/2006 |
| WO | 200800506 | | 1/2008 |
| WO | 2008000505 | A1 | 1/2008 |
| WO | 2008135116 | A1 | 11/2008 |
| WO | 200956200 | | 5/2009 |
| WO | 2009139658 | A1 | 11/2009 |
| WO | 201527169 | | 2/2015 |
| WO | 2015027169 | A1 | 2/2015 |
| WO | 2015123288 | A2 | 8/2015 |

OTHER PUBLICATIONS

Search Report dated Jul. 29, 2015 in United Kingdom Patent Application No. GB1502738.6.
Communication pursuant to Rule 114(2) dated Feb. 8, 2019 for European Application No. 20170198623.
Aage et al., "Mathematical problems for Moineau pumps", Nov. 2006, pp. 1-48.

* cited by examiner

CONICAL SCREW MACHINE WITH ROTATING INNER AND OUTER ELEMENTS THAT ARE LONGITUDINALLY FIXED

FIELD OF THE INVENTION

The present invention relates to a rotary positive-displacement machine. The invention has particular application to, but is not limited to, a conical screw compressor or pump in which an outer element and inner element are each synchronously driven by an external driving means.

BACKGROUND

A rotary positive-displacement machine is a machine that displaces a fluid by means of rotary motion. Rotary positive-displacement machines may include rotary positive-displacement pumps and rotary positive-displacement compressors.

Compressors in general may be used in a wide variety of industries (for example, oil and gas, transportation and refrigeration) to compress a variety of compressible fluids.

One known type of compressor is a screw compressor, in which two members each having a screw thread relatively rotate such that the screw threads intermesh.

It is known to design screw compressors in which each of the members has a conical geometry. Such a screw compressor may comprise a substantially conical inner element having helical grooves and lands on its outer surface, and an outer element having a substantially conical cavity having corresponding helical grooves and lands on its inner surface, such that the grooves and lands intermesh on rotation. The intermeshing grooves and lands may form continuous lines of sealing between the inner element and the outer element, forming a number of closed chambers. The grooves and lands may also be referred to as teeth, gears, threads or lobes.

In operation, a compressible fluid enters the assembly at the large end of the cone. As the inner member and outer member rotate, each of the closed chambers reduces in size as it travels from the large end to the small end of the cone, thereby compressing the compressible fluid. High-pressure fluid leaves the assembly at the small end of the cone.

One example of a screw compressor is detailed in U.S. Pat. No. 2,085,115. The compressor or pump in U.S. Pat. No. 2,085,115 comprises at least three helical gear elements positioned inside one another. The three helical elements may be considered as an outer, a middle, and an inner element. One may consider two groups of mating elements: a first group comprising the outer element and the middle element, and a second group comprising the middle element and the inner element.

In each group of two mating elements, the element with the outer screw surface has one tooth less than the second element surrounding the first element. That is, the middle element has one tooth less than the outer element, and the inner element has one tooth less than the middle element.

It may be important for achieving high efficiency of compressor operation that there is a tight contact between the compressor elements. Complexity of motion of the elements of a compressor, simultaneous interaction of multiple elements which are inserted into each other, and interaction of geometrically complex surfaces may present difficulties in achieving a tight contact between the compressor elements.

Compressor elements may be in contact with each other, and exert force on each other, along complex geometric lines of contact that may extend over the entire surface of the elements along the longitudinal axis (lines of contact that may wrap around the surface of the cone and may extend from one end of the cone to the other). In such cases, it is possible that errors may occur due to imperfections in manufacturing and/or due to backlash. Errors due to manufacturing and/or backlash may lead to imperfect movement of the compressor elements and to imperfect geometry of the lines of contact. In such circumstances, it is possible that the complexity of movement, imperfections in the movement, and forces distributed along imperfect lines of contact may cause the elements to become stuck and cease to rotate. Moreover, at high pressure it may be difficult to keep tight contact between the elements without increasing friction and wear on the elements.

It may be a complex matter to manufacture the surfaces of compressor elements with sufficient precision to ensure tight simultaneous contact between multiple elements of the compressor, where each element of the compressor has a complex geometric surface in the form of a conical spiral.

If one element is driven by the other element, much or all of the torque load may fall on the compressor screw elements, where one screw element is supposed to rotate another screw element. The torque load on the compressor screw elements may lead to an increased frictional force, and therefore to high wear of the compressor screw elements.

A further example of a conical screw compressor is, known from U.S. Pat. No. 1,892,217. A compressor or pump in accordance with U.S. Pat. No. 1,892,217 comprises two helical elements, an inner element inserted into an outer element, where the outer element has one more helical tooth than the inner element. Each tooth of the inner element has a form such that the tooth may maintain constant contact with the outer element at any cross-section. The screw compressor of U.S. Pat. No. 1,892,217 may be made in a cylindrical form or in a conical form.

In some compressor designs, the inner element makes an eccentric rolling motion within a static outer element. The centre of mass of the inner element therefore fluctuates around the central axis of the outer element. The fluctuation of the centre of mass of the inner element around the central axis of the outer element may cause vibration and noise.

In circumstances in which the inner element revolves using an eccentric rolling motion, the axis of the inner element has variable position. The distance from the centre of the inner element to the shaft of the motor is constantly varying. The varying distance from the centre of the inner element to the shaft of the motor may require that an additional device is used between the axis of the motor and the axis of the inner element to smoothly transfer torque from the motor to the inner element.

Because of the fluctuations of the axis of the inner element, the inner element may hit the outer element which may naturally reduce the service period of the compressor.

Another design of a screw compressor is known from PCT Patent Application WO 2008/000505. WO 2008/000505 describes a Moineau pump which has an outer element and an inner element, where the inner element is located inside the outer element. The outer and inner element each have a conical shape, and the elements can revolve around their longitudinal axes. Revolution of the inner element drives the rotation of the outer element or vice versa.

In some compressor designs in which revolution of one element drives the rotation of the other element, much or all of the torque load may fall on the lines of contact between the elements. In some circumstances, the application of such a torque load to the lines of contact between the element may result in high wear of the contacting surfaces, backlash, and excess clearance between the elements. Since compression of gaseous fluids may demand tight contact between the mating surfaces of the compressor's elements, increased clearances (for example, increased clearances caused by wear) may lead to a degraded efficiency of compression.

WO 2008/000505 describes compressor designs in which the inner element or outer element is designed to move along its longitudinal axis. Such movement along a longitudinal axis changes the relative longitudinal positioning of the inner element and outer element.

However, if at least one of the inner element and outer element moves along its axis, gaps between the helical teeth and grooves of the inner element and outer element can occur and gaseous fluid may leak through these gaps.

SUMMARY OF THE INVENTION

In a first, independent aspect of the invention there is provided a rotary positive-displacement machine, for example a conical screw compressor or pump, comprising an inner element configured to rotate around a first axis, and an outer element configured to rotate around a second axis. The outer surface of the inner element and the inner surface of the outer element comprise cooperating grooves and teeth that intermesh on rotation. The first axis and the second axis are each stationary and the first axis is inclined relative to the second axis. The inner element and the outer element may be configured to be, in operation, synchronously rotated by a driving means. The driving means may comprise a drive mechanism.

The synchronous rotation of the inner and outer elements may reduce or eliminate force exerted by the inner element on the outer element or vice versa. The force may be reduced in comparison to a situation in which the inner and outer elements were not each rotated in a synchronous fashion, for example in comparison to a situation in which rotation of one element drives rotation of the other element by way of contact between the elements. The force may comprise a contact force acting directly between the first and second elements.

An outer surface of the inner element may have an envelope substantially in the shape of a truncated first cone. An inner surface of the outer element may have an envelope substantially in the shape of a truncated second cone. The envelope of a three-dimensional shape may be the surface describing an outer boundary of a three-dimensional space occupied by the shape under rotation around its own longitudinal axis.

The inner element may, at least in part, be substantially in the shape of truncated cone. The outer element may, at least in part, be substantially in the shape of a truncated cone. A cavity in the outer element, in which the inner element is inserted, may, at least in part, be substantially in the shape of a truncated cone.

The inner element may have a main body substantially in the shape of a truncated cone. The inner element may have a shape such that, if grooves in its outer surface were infilled, it would have an outer surface substantially in the shape of a truncated cone. The inner element may have a shape such that, if teeth on its outer surface were removed, it would have an outer surface substantially in the shape of a truncated cone. The outer element may have a shape such that, if grooves in its inner surface were infilled, it would have an inner surface substantially in the shape of a truncated cone. The outer element may have a shape such that, if teeth on its inner surface were removed, it would have an inner surface substantially in the shape of a truncated cone.

The driving means may be an external driving means. An external driving means may be a driving means that does not comprise the inner element or the outer element. An external driving means may be a driving means that is external to the inner element and the outer element. An external driving means may be a driving means external to a housing containing the inner element and the outer element.

The inner element and the outer element may be each driven synchronously by the driving means, thereby reducing or eliminating force exerted by the inner member on the outer member or vice versa. When each of the elements is driven synchronously with a driving means, the outer element may be substantially not driven by the inner element, and the inner element may be substantially not driven by the outer element.

The inner element and the outer element each revolve around a respective stationary axis, which may be described as a static or fixed axis. Each axis remains stationary in operation. Therefore, neither of the elements performs eccentric motion.

Noise and/or vibration may be reduced when compared with a machine in which one of the inner element and the outer element drives the other of the inner element and the outer element.

Reducing or eliminating the force exerted by the inner member on the outer member or vice versa may reduce wear on one or both of the elements. By reducing wear, tight contact between the elements may be maintained. The tight contact may lead to efficient compression of gaseous fluids.

Furthermore, it may be possible to use softer materials for the elements than would be possible in a machine in which the inner element drives the outer element or vice versa, because of the reduced forces exerted on the surface of the inner element or of the outer element.

Oil may be used in compressors to reduce friction and/or to reduce the temperature of operation. If a tight contact is achieved between the elements, the amount of oil required in operation may be reduced.

The grooves and teeth may comprise helical grooves and helical teeth. On rotation the grooves and teeth may create lines of sealing which form substantially closed chambers between consecutive sealing lines.

The rotary positive-displacement machine may comprise synchronisation means configured to, in operation, synchronise the rotation of the inner element around the first axis and the rotation of the outer element around the second axis. The synchronisation means may comprise a synchronisation mechanism.

Synchronising the inner element and the outer element may significantly reduce the load on the surfaces of the elements when compared with a machine in which the inner element and the outer element are not synchronised, for example in which one of the inner element and the outer element drives the other of the inner element and the outer element. Synchronising the inner element and the outer element may lead to a reliable and durable performance of the compressor and may in some cases increase the service life of the compressor.

The synchronisation means may comprise a gear arrangement. The gear arrangement may comprise a plurality of gears, wherein at least one of the plurality of gears is configured to be driven by the driving means.

The gear arrangement may comprise a first gear and a second gear arranged such that, in operation, driving the first gear drives the inner element and driving the second gear drives the outer element. The first gear may be configured to be driven by the driving means. The second gear may be configured to be driven by the first gear, which may be driven by the driving means. The second gear may be configured to be driven by the driving means. The first gear may be configured to be driven by the second gear, which may be driven by the driving means.

The first gear and the second gear may have the same gear ratio as a ratio of a number of teeth of the inner element to a number of teeth of the outer element.

The first gear and the second gear may be in contact with each other directly. The gears may be in contact with each other via one or more intermediate gears.

The first gear may be on the same axis of rotation as the inner element. The driving means may comprise a motor, and the first gear may be on the same axis of rotation as a shaft of the motor.

One or both of the elements may be driven directly by the driving means. For example a shaft may connect the element to the driving means. One or both of the elements may be driven indirectly by the driving means, for example via one or more gears.

By synchronising the inner element and the outer element using a gear arrangement the wear on the inner element and outer element may be reduced. When compared to a compressor in which one element drives the other element, forces on the surface of the elements may be substituted by forces experienced by the gears. Therefore, wear may be experienced by the gears rather than by the elements.

The driving means may comprise at least one motor. The inner element and the outer element may be configured to each be synchronously rotated by the or each motor. The inner element and the outer element may each by synchronously rotated by the or each motor by way of the synchronisation means.

The driving means may comprise at least one of an electric motor, an alternating current motor, a direct current motor, a hydraulic motor or an internal combustion engine.

The driving means may comprise two motors, one rotating each element, and the synchronisation means may comprise a controller configured to control the two motors such that the rotation of the elements is synchronised.

Because in operation each element rotates around a respective stationary axis, there may be no need to use an additional device to compensate for variable distance between the inner element and the shaft of the motor and to smooth the transfer of torque from the motor, as may be required when one of the elements performs eccentric motion.

The rotary positive-displacement machine may further comprise a means of providing an external driving force to the inner element and a means of providing an external driving force to the outer element. The means of providing an external driving force to each element may comprise, for example, a shaft or axle.

At least part of the outer surface of the inner element may be formed from a material that is harder than a material from which at least part of the inner surface of the outer element is formed, or at least part of the inner surface of the outer element is formed from a material that is harder than a material from which at least part of the outer surface of the inner element is formed.

Part of the outer surface of the inner element that engages with the outer element (for example, at least part of the teeth and/or grooves) may be formed of a material that is harder than a material forming the surface of the outer element. In an alternative arrangement, part of the inner surface of the outer element that engages with the outer element (for example, at least part of the teeth and/or grooves) may be formed of a material that is harder than a material forming the surface of the inner element.

By forming a surface of one element from a harder material and a surface of the other element from a softer material, the softer element may at least slightly deform on contact with the harder element, resulting in a tighter contact between the two elements. The softer surface may wear in preference to the harder surface.

At least part of the surface of at least one of the inner element and the outer element may be formed from at least one of a non-metallic material, a plastic material, a resiliently deformable material, polyamide-6 or Teflon®.

The resiliently deformable material may be, for example, more resiliently deformable than steel.

By forming at least part of one or both of the contacting surfaces from a plastic material, better contact may be achieved along the lines of contact between the two elements. If at least part of the surface is formed from a material that is at least somewhat resiliently deformable, then better contact and reduced wear may be achieved.

A non-metallic material, optionally a plastic material, may be suitable for use with corrosive gases.

All of at least one of the inner element and the outer element may be formed from at least one of: a non-metallic material, a plastic material, a resiliently deformable material, polyamide-6.

Substantially all of at least one of the inner element and the outer element may be formed from at least one of: a non-metallic material, a plastic material, a resiliently deformable material, polyamide-6.

Forming all, or substantially all, of the inner element and/or the outer element from a non-metallic material, optionally a plastic material, may increase the ease of manufacturing of the inner element and/or the outer element. Forming all, or substantially all, of the inner element and/or the outer element from a non-metallic material, optionally a plastic material, may reduce the weight of the elements when compared to metallic elements.

At least one of the inner element and the outer element may comprise a main body an outer layer, wherein the outer layer is formed of a softer material than the main body. The outer layer may comprise at least one of a non-metallic material, a plastic material, a resiliently deformable material, polyamide-6, Teflon®. The main body may comprise a solid material, for example a metal, for example steel or brass.

The use of the outer layer may reduce friction between the elements. The use of a softer outer layer may increase the tightness of the contact between the elements. Increasing the tightness of contact may improve the efficiency of the positive-displacement machine. The use of an outer layer may provide increased corrosion resistance.

The outer layer may be a coating applied to the main body. The outer layer may be a material deposited on the main body. The outer layer may be applied to the main body in any other appropriate manner. The outer layer may cover part, or all, of the surface of the element to which it is applied. The outer layer may cover part, or all, of the surface that engages with the other element on rotation.

The mechanism of gearing may allow the use of softer materials, for example softer surface materials, such as softer materials forming an outer layer, than would be allowed by other driving mechanisms. Such softer materials may be favourable for use with specific gases, for example corrosive gases.

Each groove may comprise a helical groove, and the pitch of each helical groove may vary substantially continuously along the axis of the inner element or the axis of the outer element. The pitch angle of each helical groove may be substantially constant along the axis of the inner element or the axis of the outer element.

Each helical groove may have a decreasing pitch (distance between turns) along the longitudinal axis of the inner element or the outer element. The pitch of each helix may decrease substantially continuously along the longitudinal axis of the element from the large end of the element (which may be called the foot of the element) to the narrow end of the element (which may be called the top of the element). The decrease in pitch may be such that each helix has a substantially constant pitch angle along the axis of the element.

A compressor in which the helical grooves have decreasing pitch (for example, in which the pitch angle is substantially constant) may provide faster compression of gaseous fluid than may be provided by a compressor in which the helical grooves have constant pitch, because the decreasing-pitch helical grooves may result in chambers that decrease in size in three dimensions as the fluid moves along the longitudinal axis of the compressor. By contrast, constant-pitch helical grooves may result in chambers that decrease in size in two dimensions.

Each groove may comprise a helical groove, and each helical groove may have a substantially constant pitch along the axis of the inner element or the axis of the outer element, the pitch angle of each helical groove varying substantially continuously along the axis of the inner element or the axis of the outer element.

The pitch of each helical groove on the inner element or outer element may be substantially constant along the longitudinal axis of that element. The pitch angle of each helix may therefore vary substantially continuously along the axis of the inner element or the axis of the outer element. The pitch angle of each helix may increase substantially continuously along the longitudinal axis of the element from the foot of the element to the top of the element.

Given the same element size and proportions, helical grooves having constant pitch (varying pitch angle) may provide larger chambers than in the varying-pitch case, and therefore the mass flow of compressed gaseous fluid may be greater.

An element having a helical groove of substantially constant pitch may in some circumstances be easier to manufacture than an element having a helical groove having varying pitch.

The inner element and the outer element may, in operation, roll relative to each other in accordance with a pitch cone of the inner element and a pitch cone of the outer element.

The first axis may be the axis of the first cone. The first axis may be the longitudinal axis of the inner element. The second axis may be the axis of the second cone. The second axis may be the longitudinal axis of the outer element. The apex of the first cone may substantially coincide with the apex of the second cone. The first axis may intersect the second axis.

The first axis and the second axis are inclined, such that the first axis and the second axis are not parallel to each other. The angle between the first axis and the second axis may be between 0.01° and 45°. The angle between the first axis and the second axis may be between 0.1° and 10°. The angle between the first axis and the second axis may be between 0.5° and 5°.

The angle between the first axis and the second axis may be less than 45°, less than 10°, less than 5° or less than 1°. The angle between the first axis and the second axis may be greater than 0.1°, greater than 0.5° or greater than 1°.

The outer element may have a number of grooves that is one greater than a number of grooves of the inner element. The outer element may have at least one groove, and each groove may have a wrap angle that exceeds 360°. The radial depth of the grooves may vary along the axis of the inner element or of the outer element such that the radial depth of each groove in each transverse plane of the inner element or of the outer element is equal to twice the eccentricity of the first axis with respect to the second axis.

The rotary positive-displacement machine may further comprise a housing in which the inner element and the outer element are positioned. The housing may be a stationary housing.

The length of at least one of the inner element and the outer element may be between 10 mm and 10 m, optionally between 40 mm and 2 m, optionally between 0.5 m and 2 m. The length of at least one of the inner element and the outer element may be less than 10 m, less than 1 m, or less than 100 mm. The length of at least one of the inner element and the outer element may be greater than 10 mm, greater than 100 mm, greater than 500 mm, or greater than 1 m.

The rotary positive-displacement machine may be operated in a particularly energy-efficient manner due, for example, to the tight contact that may be achieved between the elements and the resulting efficiency of compression. The conical screw compressor of the above embodiments may therefore reduce emissions of carbon dioxide.

The rotary positive-displacement machine may be particularly well suited to applications in which physical space is limited, for example oil and gas offshore platforms, offshore carbon capture and storage, mining, submarines, ships and spacecraft. Some applications, such as submarines, may have both limited space and a requirement for high volumes of compressed gases.

The positive-displacement machine may have increased reliability, for example due to decreased wear on the elements. Synchronisation of the elements may significantly increase the life of the compressor and extend maintenance intervals. Increased life and maintenance intervals may be of benefit in applications in which maintenance and/or replacement of a compressor may be difficult and/or costly, for example in oil and gas offshore platforms, offshore carbon capture and storage, mining, submarines, ships and spacecraft Due to the precise positioning of the conical screw elements, specialized coatings may be used for compressor operation in aggressive media such as carbon dioxide, hydrocarbon gases, sulphur dioxide and similar gases.

The rotary positive-displacement machine may have no eccentric motion of elements, and may therefore be suitable for applications requiring low vibration and/or noise. Applications requiring low vibration and noise may include applications where members of the public are near the compressor, for example for compressors in buses and trains. A conical screw compressor that has reduced noise or vibration may reduce the need for additional vibration reduction measures and/or noise reduction measures. In an industrial environment (for example, an oil rig), it may become possible to stay within a noise limit for people working nearby. Reduced vibration and noise may also be important in applications such as submarines in which low noise and vibration is required from all components.

In a further, independent aspect of the invention there is provided a rotary positive-displacement machine comprising an inner member configured to rotate around a first axis, the outer surface of the inner member having an envelope in the shape of a truncated first cone, and an outer member configured to rotate around a second axis, the inner surface of the outer member having an envelope in the shape of a truncated second cone. The outer surface of the inner member and the inner surface of the outer member comprise cooperating grooves and lands that intermesh on rotation, the grooves and lands creating lines of sealing which form closed chambers between consecutive sealing lines. The first axis and the second axis are both stationary and the first axis is not parallel to the second axis.

In a further, independent aspect of the invention there is provided a rotary positive displacement machine comprising an inner element configured to rotate around a first lateral axis, the first lateral axis being a first fixed axis of revolution, and an outer element configured to rotate around a second lateral axis, the second lateral axis being a second fixed axis of revolution. The inner element is positioned within the outer element. The first fixed axis of revolution and the second fixed axis of revolution are inclined to each other and intersect in a focal point. The inner element and the outer element are synchronised in such a manner that the inner element and the outer element do not exert force on each other during their revolution. The outer surface of the inner element and the inner surface of the outer element comprise cooperating grooves and teeth that intermesh in rotation, the grooves and teeth creating lines of sealing which form closed chambers between consecutive sealing lines.

The first fixed axis of revolution may be the axis of the first cone. The second fixed axis of revolution may be the axis of the second cone. The first fixed axis of revolution and the second fixed axis of revolution may intersect.

In a further, independent aspect of the invention there is provided a method of operating a rotary positive-displacement machine, for example a conical screw compressor or pump, wherein the rotary positive-displacement machine comprises an inner element configured to rotate around a first axis and an outer element configured to rotate around a second axis, wherein an outer surface of the inner element and an inner surface of the outer element comprise cooperating grooves and teeth that intermesh on rotation, wherein the first axis and the second axis are each stationary and the first axis is inclined relative to the second axis and wherein the method comprises synchronously rotating the inner element and the outer element, thereby to reduce or eliminate force exerted by the inner element on the outer element or vice versa.

In another aspect, which may be provided independently, there is provided a rotary positive displacement machine, for example a conical screw compressor or pump, comprising: an inner element configured to rotate around a first axis; an outer element configured to rotate around a second axis; and means for substantially fixing a longitudinal position of the inner element along the first axis and for substantially fixing a longitudinal position of the outer element along the second axis, so as to substantially maintain a relative longitudinal positioning of the inner element and the outer element during rotation; wherein an outer surface of the inner element and an inner surface of the outer element comprise cooperating grooves and teeth that intermesh on rotation; the first axis and the second axis are each stationary and the first axis is inclined relative to the second axis.

The means for substantially fixing the longitudinal positions of the inner and outer elements may comprise an axial bearing in contact with a substantially end-facing surface of the inner element. The means for substantially fixing the longitudinal positions may comprise a fixing mechanism.

The means for substantially fixing the longitudinal positions of the inner and outer elements may comprise an axial bearing between a substantially end-facing surface of the inner element and a discharge side of the housing.

The axial bearing may be located proximate to the discharge end of the inner element.

The axial bearing may be located between the discharge end of the inner element and the discharge side of the housing. The axial bearing may be substantially aligned with the first axis of the inner element.

An end, for example a top end, of the inner element may be stepped, and the substantially end-facing surface may comprise a step surface of the inner element, the step surface facing the discharge end of the compressor.

The axial bearing may be disposed between the substantially end-facing surface of the inner element and a surface of a recess in the outer element.

The axial bearing may be disposed between the substantially end-facing surface of the inner element and a surface of a recess in the housing.

The rotary positive displacement machine may further comprise a housing in which the inner and outer elements are positioned. The means for substantially fixing the longitudinal positions of the inner and outer elements may further comprise at least one bearing between the outer element and the housing. The at least one bearing may be configured to allow relative axial rotation of the outer element and the housing while restricting longitudinal motion of the outer element and the housing.

The outer element may comprise a surface proximate to the suction end of the outer element. At least one of the bearings may be disposed between the surface and the housing.

The at least one bearing between the outer element and the housing may comprise a bearing proximate to the discharge end of the outer element and a further bearing proximate to the suction end of the outer element.

The means for substantially fixing the longitudinal positions of the inner and outer elements may further comprise at least one bearing between the inner element and the housing. The at least one bearing between the inner element and the housing may be configured to allow relative axial rotation of the inner element and the housing while restricting relative longitudinal motion of the inner element and the housing.

The inner element may be coupled to a shaft. The means for substantially fixing the longitudinal positions of the inner and outer elements may further comprise at least one bearing between the shaft and the housing. The at least one bearing between the shaft and the housing may be configured to allow relative axial rotation of the inner element and the housing while restricting relative longitudinal motion of the inner element and the housing.

The means for substantially fixing the longitudinal position of the inner and outer elements may comprise at least one gear.

Substantially fixing the longitudinal position of each of the inner element and the outer element may comprise fixing the longitudinal position to within 3% of the length of the element, optionally to within 0.1% of the length of the element, further optionally to within 0.01% of the length of the element, further optionally to within 0.001% of the length of the element.

At least one of the inner element and outer element may be configured to be driven by a driving means.

The inner element may be configured to be driven by a driving means, and the outer element is configured to be driven by the inner element.

The outer element may be configured to be driven by a driving means, and the inner element may be configured to be driven by the outer element.

The rotary positive displacement machine may further comprise means for adjusting the relative longitudinal positioning of the inner element and the outer element thereby to balance tightness of fit and/or heat generated The rotary positive displacement machine may further comprise a further element at the suction end of the outer element. The further element may be substantially aligned with the second axis of the outer element. The further element may comprise a mounting location for mounting a bearing for the inner element. The mounting location may be substantially aligned with the first axis of the inner element.

The mounting location may be radially offset from a centre point of the further element. The further element may be substantially circular.

The further element may comprise a cover.

A central axis of the further element, optionally cover, may be aligned with the second axis of the outer element. A central axis of the mounting location may be substantially aligned with the first axis of the inner element.

The further element may be configured to maintain a substantially fixed angle between the first axis and the second axis.

There may be provided a cover situated at the second longitudinal axis comprising an eccentric place for mounting the bearing on the internal element so that the axis of the bearing is the first axis which is eccentrically positioned relative to the second axis.

In a further aspect of the invention, which may be provided independently, there is provided a method of operating a rotary positive displacement machine, for example a conical screw compressor or pump, the rotary positive displacement machine comprising: an inner element configured to rotate around a first axis; an outer element configured to rotate around a second axis, wherein: an outer surface of the inner element and an inner surface of the outer element comprise cooperating grooves and teeth that intermesh on rotation; the first axis and the second axis are each stationary and the first axis is inclined relative to the second axis; and the method comprising: substantially fixing a longitudinal position of the inner element along the first axis and substantially fixing a longitudinal position of the outer element along the second axis, so as to substantially maintain a relative longitudinal positioning of the inner element and the outer element during rotation; and rotating the inner element and outer element.

In another aspect, which may be provided independently, there is provided a rotary positive displacement cycloidal compressor having conical gearing for compressible working fluid, comprising an external conical screw working element and internal conical screw working element positioned inside the outer housing, wherein said working external conical screw element revolves around its longitudinal axis forming a first fixed axis of revolution and said internal conical screw working element revolves around its longitudinal axis forming a second fixed axis of revolution, wherein the first axis of revolution and the second axis of revolution are inclined to each other and the inner element is driven by the outer element or vice versa, and said internal screw working element and external conical screw working elements are mounted in said external housing in such a way that they can only revolve around their longitudinal axes inside said housing.

Said internal working conical screw element may be mounted inside the said external working conical screw element in such a way that said internal working conical screw element can only revolve around its longitudinal axis. Said internal working conical screw element may have at least one grove and at least one tooth. Said teeth and groves may have conical and spiral form. The internal and external working conical elements may make rolling motion against each other on pitch cones at coinciding peaks. The external element may revolve around its axis and the internal element may revolve around its axis. The external and internal conical elements may be positioned inside the stationary housing and may conduct mating revolution. The number of grooves in the external working conical element may be greater than the number of groves in the internal working conical element by one. The angle coverage of each grove in the external conical working element may be greater than 360 degrees. The radial depth of the grooves of the internal screw working element and of the external screw working element may change along their axes and in every cross-section may be substantially equal to twice the eccentricity between the axes of said elements.

In another independent aspect of the invention, which may be provided independently, there is provided a conical screw compressor or pump comprising: an inner element configured to rotate around a first axis; an outer element configured to rotate around a second axis; and a fixing mechanism for substantially fixing a longitudinal position of the inner element along the first axis and for substantially fixing a longitudinal position of the outer element along the second axis, so as to substantially maintain a relative longitudinal positioning of the inner element and the outer element during rotation; wherein an outer surface of the inner element and an inner surface of the outer element comprise cooperating grooves and teeth that intermesh on rotation; the first axis and the second axis are each stationary and the first axis is inclined relative to the second axis.

There may be provided a rotary positive-displacement machine, or a method of operating a rotary positive-displacement machine, substantially as described herein with reference to the accompanying drawings.

Any feature in one aspect of the invention may be applied to other aspects of the invention, in any appropriate combination. For example, apparatus features may be applied to method features and vice versa.

DETAILED DESCRIPTION OF EMBODIMENTS

Embodiments of the invention are now described, by way of non-limiting example, and are illustrated in the following figures, in which.

Figure 6A:
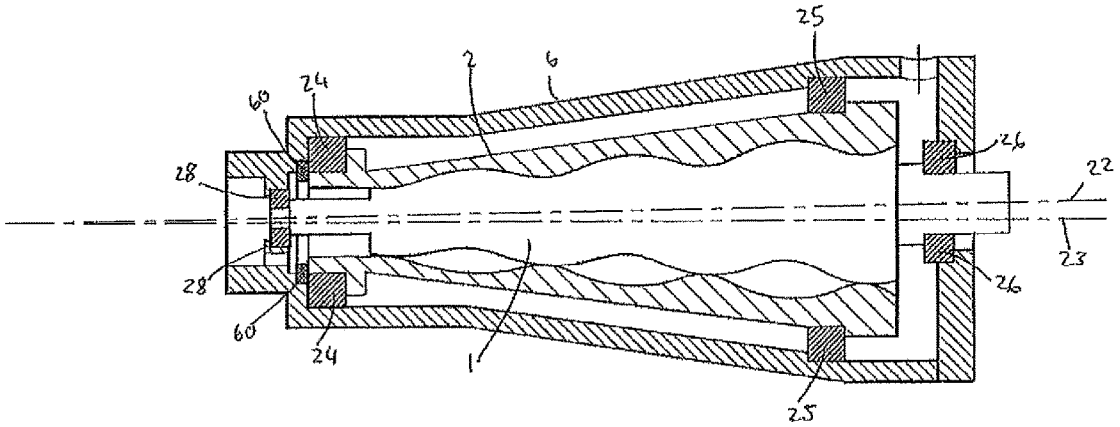
Figure 6B:
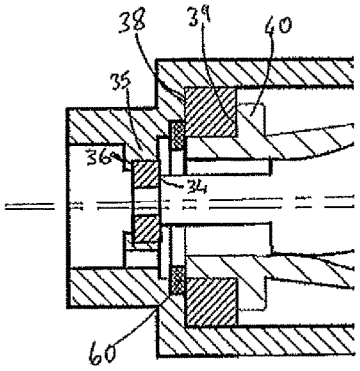
Figure 6C:
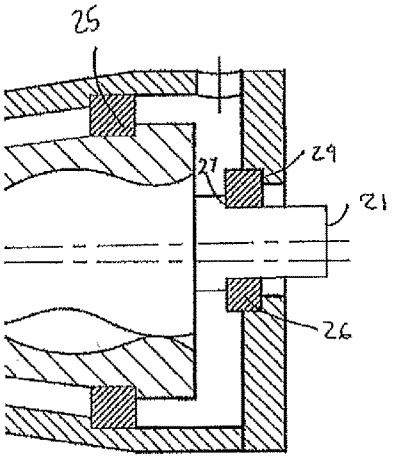
Figure 7:
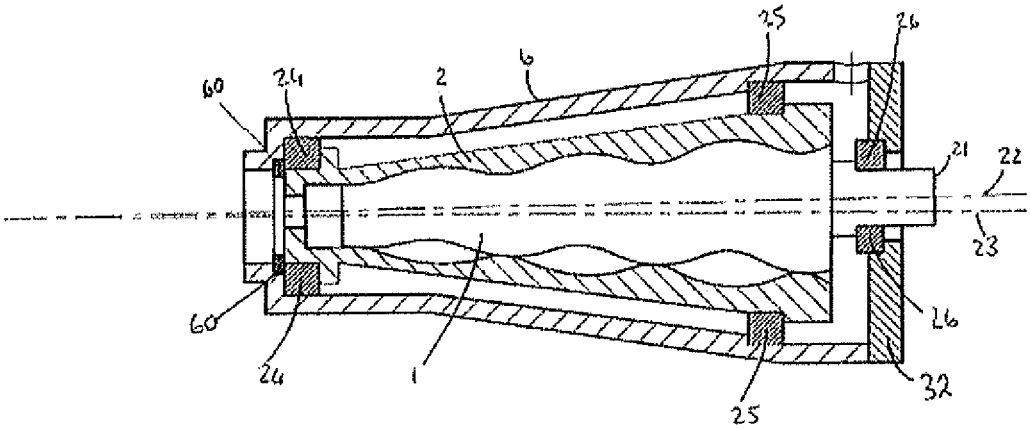
Figure 8A:
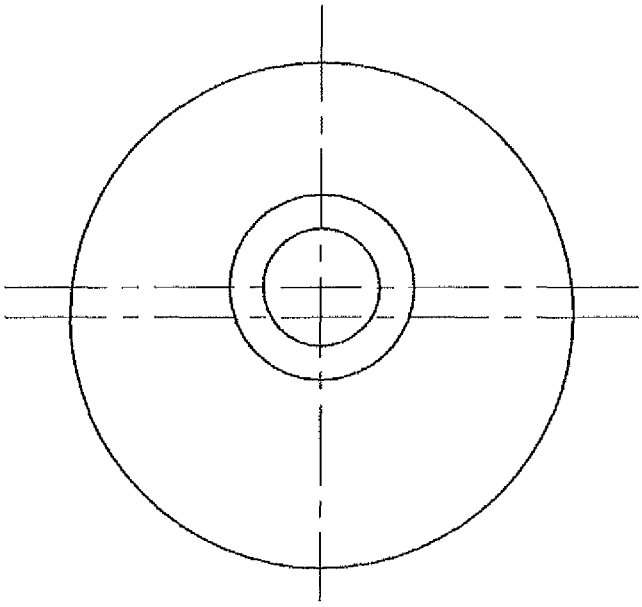
Figure 8B:
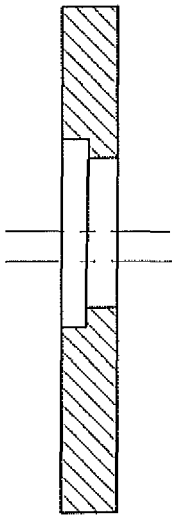

FIG. 6*a* is a schematic longitudinal section view of a compressor according to a further embodiment;

FIGS. 6*b* and 6*c* are enlarged views of the top and bottom end of FIG. 6*a* respectively;

FIG. 7 is a schematic longitudinal section view of a compressor according to another embodiment;

FIGS. 8*a* and 8*b* are schematic views of a cover of the compressor of FIG. 7.

Figure 1:
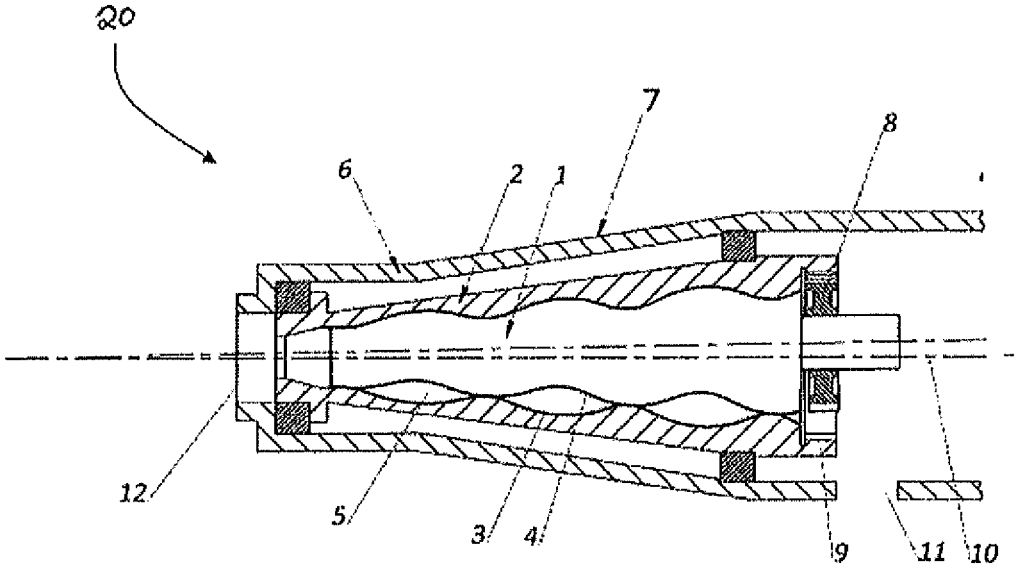
FIG. 1 is a schematic longitudinal sectional view of a compressor according to an embodiment.

In a first embodiment, illustrated in FIG. 1, a conical screw compressor 20 comprises an inner element 1 and an outer element 2. The outer surface 4 of the inner element 1 is substantially in the shape of a truncated first cone. The outer surface 4 of the inner element 1 comprises a plurality of helical teeth.

The inner surface 3 of the outer element 2 is substantially in the shape of a truncated second cone. The inner surface 3 of the outer element 2 comprises a plurality of helical teeth, one more than the number of helical teeth of the inner element 1. Each helical tooth on the inner element 1 and on the outer element 2 follows a helix of constant pitch (decreasing pitch angle from the wide end to the narrow end of the cone).

The shape of the inner element 1 and outer element 2 may be determined, for example as part of a design or manufacturing process, using a method disclosed in PCT Application PCT/GB2013/051497, which is hereby incorporated by reference.

The inner element 1 and the outer element 2 are arranged inside a housing 6 of the compressor 20. Both the inner element 1 and the outer element 2 can revolve inside the housing 6.

The inner element 1 is coupled to a first gear 8 (which may be called a pinion) which has external teeth. The outer element 2 is coupled to a second gear 9 which has internal teeth. The internal teeth of the second gear 9 mesh with the external teeth of the first gear 8. The gear ratio of the first gear 8 to the second gear 9 equals the ratio of the number of teeth of the inner element 1 to the number of teeth of the outer element 2.

Figure 2:
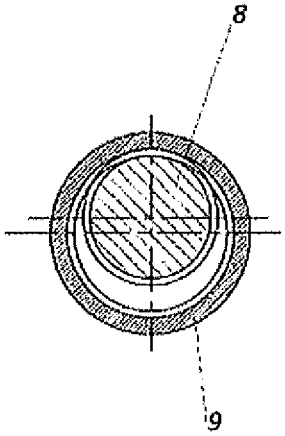
FIG. 2 is a schematic front view of the compressor of FIG. 1.

FIG. 2 shows an end view (cross-sectional view) of first gear 8 inside second gear 9.

The first gear 8 is coupled with the shaft of an electric motor 14 (the electric motor 14 is not shown in FIG. 1). The shaft of the electric motor 14 lies along the axis of the inner element 1, which is the same axis as the axis of the first gear 8.

The shaft of the electric motor 14 drives the inner element 1. The shaft of the electric motor 14 drives the first gear 8 which is coupled with the inner element 1. The first gear 8 in turn drives the second gear 9 which is coupled with the outer element 2. When the gears 8, 9 start revolving around their axes, they start rotating the inner element 1 and outer element 2 of the compressor 20.

The inner element 1 rotates around its longitudinal axis, which may be referred to a first axis, and the outer element 2 rotates around its longitudinal axis, which may be referred to as a second axis. The first axis and second axis are inclined to each other (not parallel), with an angle between the axes. In the embodiment of FIG. 1, the first axis intersects the second axis, with an angle between the axes of 1°.

On rotation of the elements, the helical teeth of the inner element 1 mate with the helical teeth of the outer element 2, forming lines of contact between the inner element 1 and outer element 2. The lines of contact form substantially closed helical chambers 5 between the inner element 1 and the outer element 2.

On revolution, a compressible fluid (for example, a gaseous fluid) is sucked through the inlet port 11 into a chamber 5 between the inner element 1 and the outer element 2. In the present embodiment, the inlet port 11 is placed adjacent to the end of the outer element 2 at the large end of the cone. In alternative embodiments, the inlet port 11 may be placed at any position near the large end of the cone, for example at any position that facilitates ease of use.

Since the inner element 1 and the outer element 2 each have a conical shape and the grooves are helical, as the inner element 1 and the outer element 2 revolve, the chamber 5 moves along the longitudinal axis of the compressor 20, and decreases in volume. The decrease in volume of the chamber 5 results in compression of the compressible fluid. The compressible fluid increases in pressure.

When the chamber 5 reaches the narrow end of the compressor 20, the compressed fluid is discharged through the outlet port 12. A high pressure seal is used at the outlet 12. In the present embodiment, the high-pressure seal is a metal face seal. In other embodiments, any suitable high-pressure seal may be used. It may be necessary for the high-pressure seal to be able to deal with high speed revolution on one side (for example, 1500 rpm) and high pressure.

During operation of the conical screw compressor 20 of FIG. 1, each of the axis of rotation of the inner element 1 and the axis of rotation of the outer element 2 remains in a fixed, stationary position as the elements rotate around their respective axes. Neither of the elements 1, 2 performs eccentric motion.

The inner element and the outer element are each driven by the motor rather than by the other element. Therefore, force exerted by the inner element on the outer element or vice versa is reduced or eliminated.

Accurate positioning of the axes is achieved through accurate design and manufacturing of the housing 6 of the compressor 20. The shafts are positioned in part of the housing 6 which comprises covers that sit on both sides of the cone.

In the embodiment of FIG. 1, the length of the compressor 20 is 189 mm and the perpendicular dimensions of the compressor are 95 mm by 95 mm. The tolerance on the elements is 10 micrometers.

In the embodiment of FIG. 1, the outer element 2 is made of alloy steel and the inner element 1 is made of brass. In the embodiment of FIG. 1, brass is used for one element and alloy steel for the other because brass is softer than alloy steel. If any manufacturing inaccuracies are present, the brass may deform or wear in preference to the alloy steel, resulting in an improved fit between the inner element 1 and the outer element 2.

In the embodiment of FIG. 1, oil is used to lubricate the motion of the elements 1, 2 and to reduce the temperature in the compressor in operation. The good fit between the inner element 1 and outer element 2 may allow less oil to be used than may be required in a compressor of an alternative design, for example one in which one element drives the other.

Figure 3:
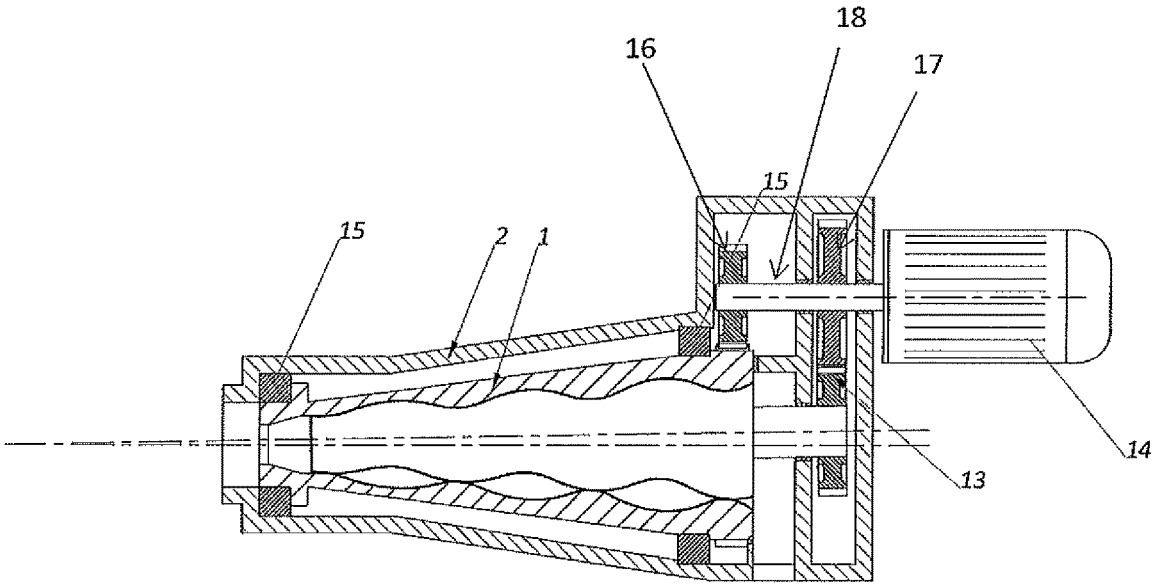
FIG. 3 is a schematic longitudinal sectional view of a compressor according to a further embodiment.

An alternative embodiment of a conical screw compressor is illustrated in FIG. 3. The embodiment of FIG. 3 offers an alternative implementation of the synchronisation of the conical screw elements 1, 2 to the embodiment of FIG. 1. In the embodiment of FIG. 3, only gears with external teeth are used in the synchronisation of the conical screw elements 1, 2.

The inner element 1 and outer element 2 of the embodiment of FIG. 3 are arranged and operated in a similar way to the inner element 1 and outer element 2 of the embodiment of FIG. 1.

In the embodiment FIG. 1, the motor 14 shares a common axis with the inner element 1, and is connected to inner element 1 by a shaft. By contrast, in the embodiment of FIG. 3, neither element is connected directly to the motor 14 by a shaft. Both elements are synchronized and driven simultaneously by the motion of gears 13, 16 and 17. In the embodiment of FIG. 3, the gears have external teeth meshing with each other and driven by a motor shaft 18. Gear 16 is driven by shaft 18 and drives outer element 2. Gear 17 is driven by motor shaft 18 and drives gear 13, which drives inner element 1.

In alternative embodiments, any suitable gear mechanism may be used to drive the inner element 1 and the outer element 2 synchronously.

In the embodiment of FIG. 3, the inner element 1 and the outer element 2 are synchronised in such a way that the rotational speed ratio of the inner element 1 and the outer element 2 equals the ratio of teeth of the screw surfaces of those elements. In the embodiment of FIG. 3, inner element 1 and the outer element 2 are installed with the bearings 15 inside the compressor housing 6.

In the embodiment of FIG. 3, motor 14 is an alternating current motor. In alternative embodiments, motor 14 is a direct current motor, a hydraulic motor, an internal combustion engine, or any suitable means of driving the rotation of the inner element 1 and outer element 2. In other embodiments, a driving means that does not comprise a motor may be used to drive the rotation of the inner element 1 and outer element 2.

In some embodiments, a first motor is used to rotate the inner element 1 and a second motor is used to rotate the outer element 2. The first motor may be connected directly to the inner element 1, for example by a shaft, or connected indirectly to the inner element 1, for example using gears. The second motor may be connected directly to the outer element 2, for example by a shaft, or connected indirectly to the outer element 2, for example using gears. The first motor and second motor may be controlled by a controller such that the rotation of the inner element 1 is synchronised with the rotation of the outer element 2.

Figure 4:
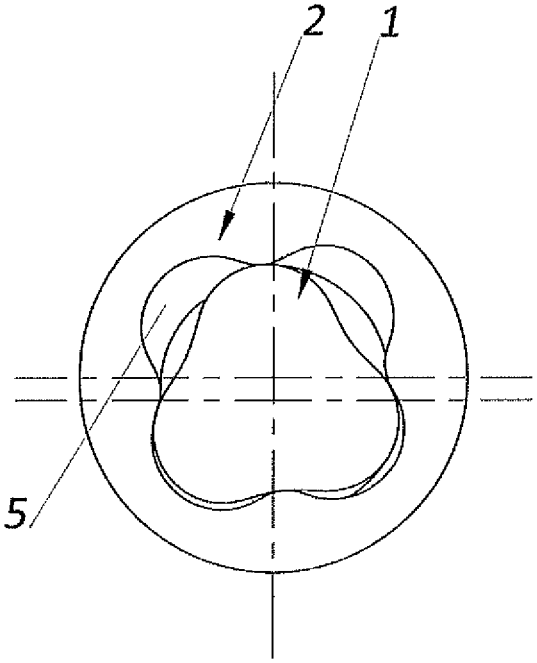
FIG. 4 is a cross-section of the screw elements of an embodiment.
Figure 5:
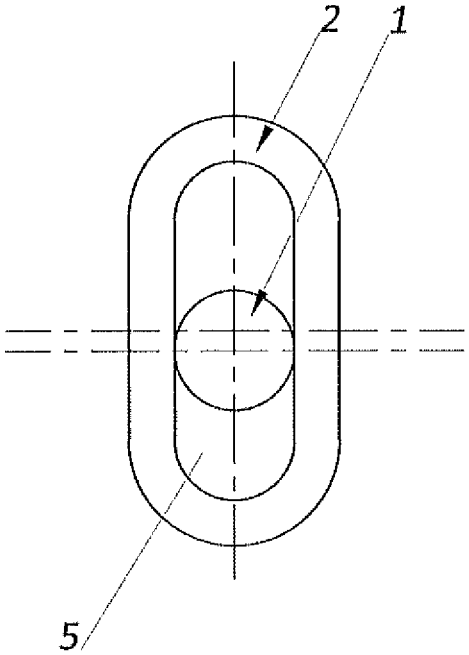
FIG. 5 is a cross-section of the screw elements of another embodiment.

Although particular arrangements of helical grooves are illustrated in FIG. 1 and FIG. 3, in alternative embodiments, any appropriate number or arrangement of grooves may be used. FIG. 4 shows a cross section of an inner element 1 having three helical grooves and an outer element 2 having four helical grooves. FIG. 4 also shows chambers 5 between the inner element 1 and outer element 2. FIG. 5 shows an alternative design of an inner element 1 and outer element 2. In different embodiments, different numbers of helical grooves may be used.

In the embodiment of FIG. 1, the helical grooves have constant pitch (variable pitch angle). In other embodiments, the helical grooves have varying pitch, for example continuously varying pitch. In some embodiments the helical grooves have a varying pitch such that the pitch angle remains constant along the length of the inner or the outer element 1, 2.

In the above embodiments, each helical groove extends along the entire length of the inner or outer element 1, 2. In alternative embodiments, each helical groove may extend along at least part of the length of the inner or outer element 1, 2.

The compressor 20 of FIG. 1 was produced as a prototype of 189 mm in length. In alternative embodiments, the compressor 20 may be produced to a wide range of dimensions. For example, the length of the compressor may be in a range from 10 mm to 5 m. Smaller compressors 20, for example from 10 mm to 100 mm may be used for certain applications, for example for use in air conditioners. Larger compressors, for example from 0.5 to 2 m or greater, may be used, for example, in oil and gas applications.

The elimination or reduction of force exerted by the inner element 1 on the outer element 2 (or vice versa) by driving the elements synchronously may have a particular impact in the case of a large compressor.

A small compressor may not have large torque compared to the properties of the materials used to fabricate the compressor. However, in a large compressor (for example, a 1 meter long compressor) the elements have a large mass. Therefore there is a large torque. The area of contact between the inner element 1 and outer element 2 is only a line so there is a small contact area. If one element drives the other, the resulting hysteresis and wear may be large. If one element drives the other, a larger compressor may experience greater wear than would be experienced by a small compressor. Therefore, synchronisation of the elements may lead to a greater reduction in wear for a large compressor than would be seen in a small compressor.

In further embodiments, an outer layer, for example a coating layer, is applied to at least part of the outer surface 4 of the inner element 1 and/or to at least part of the inner surface 3 of the outer element 2. Such a coating may reduce friction forces and/or increase corrosion resistance. In one embodiment, the coating material is Teflon®. In other embodiments, the coating material is any friction-reducing material. In further embodiments, the coating material is any corrosion-resistant material. In some embodiments, one or both elements comprises a main body with an outer layer covering part or all of the surface of the main body. In some embodiments, the main body is a solid material, for example a metal, and the outer layer is a softer material, for example a plastic.

In the embodiment of FIG. 1, one element is formed from alloy steel and the other element from brass. In an alternative embodiment, each of inner element 1 and outer element 2 is fabricated from an industrial plastic, Polyamide-6 (which is sold by BASF under the trade name Ultramid®). Elements made from plastic material, such as Polyamide-6, may be suitable for use with corrosive gases. Plastic may deform and restore its shape as it comes in and out of contact, which may achieve a tighter contact between the elements when the elements are made of plastic than if the elements were made of a harder material, for example a metallic material.

In the embodiment of FIG. 1, oil is used for lubrication. In other embodiments, oil may also be used for cooling. In embodiments in which the surface of one or more of the elements is made of a softer material, for example a plastic material, the use of oil for lubrication may be reduced or eliminated.

Synchronously driving the inner element 1 and outer element 2 using the motor 14 may reduce wear on the element, and allow for more accurate tolerances and a better fit between the elements. If the fit between the elements is improved, less oil may be required to be used.

In some embodiments, positioning the axes of the elements accurately reduces wear on the elements. In some embodiments, positioning the axes accurately may allow the clearance between the elements to be precisely set. In one such embodiment, the compressor 20 is designed to compress a gaseous fluid which comprises small solid particles, for example dust or sand. The clearance between the elements may be precisely set to take into account the size of the particles. Precisely setting the clearance may increase the lifetime of the compressor.

A conical screw compressor of a further embodiment is illustrated in FIGS. 6*a*, 6*b* and 6*c* (where FIGS. 6*b* and 6*c* are detailed views of parts of FIG. 6*a*).

The conical screw compressor 20 of FIG. 6*a* comprises an inner element 1 and an outer element 2 having helical teeth and grooves similar to those described with reference to FIG. 1. The inner element 1 is a solid element (although it is represented as unshaded in FIGS. 6*a* to 6*c*).

The inner element 1 is coupled to a shaft 21 which is driven by a motor 14 (not shown in FIG. 6*a*). In operation, the motor 14 (via shaft 21) drives the inner element 1 to rotate around its longitudinal axis (first axis 22). The rotation of inner element 1 drives a rotation of the outer element 2 around the outer element's own longitudinal axis (second axis 23), which is inclined relative to the longitudinal axis 22 of inner element 2.

The inner element 1 is substantially fixed in a longitudinal position along its axis of rotation 22. The outer element 2 is substantially fixed in a longitudinal position along its axis of rotation 23. The axes 22, 23 are also in fixed positions. A relative longitudinal positioning of the outer element 2 and the inner element 1 is substantially maintained because the inner element 1 and outer element 2 are held in a relative fixed position so that the inner surface 3 of the outer element 2 and outer surface 4 of element 1 form a tight fit and gas is maintained in the closed chambers 5 between the inner element 1 and outer element 2.

Inner element 1 and outer element 2 are relatively longitudinally positioned by a bearing, for example an axial bearing, 28. The bearing 28 is in contact with a substantially end-facing surface 34 of the inner element 1.

In the embodiment of FIG. 6*a*, the top end of the housing 6 comprises a recess 35 having an inner surface 36 aligned with the top of inner element 1. An end-facing surface 34 of inner element 1 faces the inner surface 36 of the outer element 2. The axial bearing 28 is disposed between the recess inner surface 36 of the housing 6 and the end-facing surface of the inner element 1.

In some embodiments, the top end of inner element 1 is stepped, and an end-facing step surface 34 faces the inner surface 36 of the housing 6.

In some embodiments, the top end of outer element 2 comprises a recess having an inner surface aligned with the top of inner element 1. The axial bearing 28 is disposed between the recess inner surface of the outer element 2 and an end-facing surface of the inner element 1, for example an end-facing step surface of the inner element 1.

Although in the present embodiment the axial bearing 28 is in contact with end-facing step surface 34, in other embodiments, the axial bearing 28 may be in contact with any substantially end-facing surface of the inner element 1 and any suitably facing surface of the outer element 2.

In further embodiments, the axial bearing may be in contact with any substantially end-facing surface of the inner element 1 and any suitably facing surface of the housing 6.

The inner element 1 is fixed in the housing 6 by a bearing, for example a radial bearing, 26 between the shaft 21 and the housing 6. In the embodiment of FIG. 6, the shaft 21 comprises a step having a surface 27 facing part of the housing 6 which covers the bottom end of the compressor. This cover part of housing 6 has a corresponding notch 29 such that, longitudinally, the radial bearing 26 is disposed between the step surface 27 and the notch 29.

The inner element 1 is fixed in the housing 6 by bearing 26 in such a manner that the motion of the inner element 1 is limited to rotation around its longitudinal axis 22. The arrangement of the bearing 26 between the inner element 1 and the housing 6 may ensure that the inner element 1 cannot move along its axis 22 relative to the outer element 2, and therefore may limit the possibility of gas leakage through gaps between inner element 1 and outer element 2.

The outer element 2 comprises a corresponding flange 40 which extends substantially perpendicularly to the outer element's longitudinal axis 23. The flange 40 faces the housing inner surface 38.

Bearing 24 is disposed between the outer element 2 and the housing 6 in the radial direction. Bearing 24 is disposed between the housing inner surface 38 and a surface of flange 40 in the longitudinal direction, thereby fixing the longitudinal position of the outer element 2 relative to the housing 6. Bearing 24 is a radial bearing which limits the relative movement of outer element 2 and housing 6 to a rotation of the outer element 2 around its longitudinal axis 23.

In other elements, bearing 24 may be longitudinally disposed between any inner surface of the housing and any suitable surface of outer element 2.

A high-pressure seal 60 is disposed between the end of the outer element 2 and the housing 6.

A further bearing, for example a further radial bearing, 25 is placed between the outer element 2 and the housing 6 proximate to the bottom end of the outer element 2. The longitudinal position of bearing 25 is determined by a lip in the housing 6 having a surface perpendicular to the longitudinal axis 23 and a corresponding, facing, lip in the outer element 2.

The outer element 2 is fixed in the static housing 6 by the two bearings 24, 25 in such a manner that the motion of the outer element 2 is limited to rotation around its longitudinal axis 23.

The arrangement of the bearings 24, 25 between the outer element 2 and the housing 6 may ensure that the outer element 2 cannot move along its axis relative to the inner element 1 and may in limit the possibility of gas leakage through gaps between the inner element 1 and outer element 2.

In other embodiments, the outer element 2 may be fixed in the housing 6 by any configuration of two or more bearings, which may be placed at any appropriate positions along the length of the outer element 2.

The inner element 1 and outer element 2 each rotate around a respective fixed axis. Since the inner element 1 is fixed in the housing 6 by bearing 26, the inner element 1 may make no other motion than revolving around its axis 22. Therefore, a large proportion of the energy in the system may be used to compress gas. By avoiding other forms of motion such as an eccentric oscillatory motion of the inner element 1, the system may be made more efficient and energy wastage may be reduced.

Fixing the inner element 1 inside the outer element 2 with axial bearing 28 may allow the relative position of the inner element 1 and the outer element 2 to be set accurately. As a result, tolerances may be reduced. By setting the relative position of the inner element 1 and outer element 2 accurately, the use of unnecessary force may be avoided and it may be possible to avoid unnecessary friction between the surfaces of the inner element 1 and the outer element 2.

The inner element 1 is held by bearings on two sides, and the outer element 2 is held by bearings on two sides. Due to the elements being held by the bearings, the position of the inner element 1 and the position of the outer element 2 can be accurately set up relative to each other and relative to the housing. Such a configuration may be particularly effective when the inner element 1 and outer element 2 are manufactured from hard materials such as steel.

A further embodiment is illustrated in FIG. 7.

The embodiment of FIG. 7 comprises an inner element 1, outer element 2, and housing 6 similar to those of FIG. 6. The outer element 2 is fixed by two bearings 24, 25.

The inner element is fixed by one bearing 26 on the bottom end. The top end of the inner element 1 is fixed by the surface of the outer element 2, in the lines of contact between the inner element 1 and the outer element 2.

The inner element 1 in its position may push the surface of the outer element 2 along the lines of contact, and may thereby create better sealing between the elements, separate the closed chambers 5, and prevent the compressible fluid in the chambers from escaping. A configuration such as that in FIG. 7, in which the inner element 1 is held by one bearing 26, may be particularly effective when at least one of the inner element 1 and outer element 1 is made from a soft material such as a polymer.

The compressor 20 further comprises a high-pressure seal 60 disposed between the end of the outer element 2 and the housing 6, and a connector for a pipe or other conduit at the discharge end of the compressor (not shown) for removing compressed fluid.

In the embodiment of FIG. 7, the housing 6 comprises a cover 32 which covers the bottom end of the compressor. Cover 32 is illustrated in FIGS. 8*a* and 8*b*.

Cover 32 is configured so as to hold the relatively inclined axes 22, 23 of the two elements in a fixed manner. The cover has two axes: a) a main axis which sits on the same longitudinal position as the second axis 23 of the outer element 2 and b) a place for mounting the bearing 26 for the inner element 1 having an offset resulting in the first axis 22 (the axis of the inner element 1) being inclined relative to the second axis. In FIGS. 8*a* and 8*b*, the offset resulting in the relative inclination is exaggerated for clarity.

In a further embodiment, the housing 6 comprises a housing cover which covers the bottom end of the compressor. Attached to the housing cover is a bearing cover.

The bearing cover comprises a plate covering the bottom end of radial bearing 26 and a cylindrical section surrounding radial bearing 26. Radial bearing 26 is located between the shaft 21 and an inner surface of the cylindrical section of the bearing cover.

The housing cover and bearing cover are designed so as to hold the shaft 21 of the inner element 1 at an appropriate angle of inclination relative to the axis of the outer element 2. The housing cover and bearing cover may form a detachable unit.

A compressible fluid is injected into the compressor through a nozzle.

The bottom end of outer element 2 is covered by an outer element cover. The outer element cover is a broadly annular structure having a longitudinal extent such that bearing 25 may be placed radially between a radially outer surface of the outer element cover and a radially inner surface of the housing cover.

At the top end of the compressor, the outer element 2 extends to form a tubular region which extends beyond the end of the inner element 1. To the flange 40 is affixed an endpiece. Radial bearing 24 is placed between the endpiece and a part of the housing 6.

In the embodiments of FIGS. 6 and 7, each of the bearings comprises a ball bearing or plurality of ball bearings. In other embodiments, any suitable type of bearing may be used.

In some embodiments, the compressor comprises means for adjusting the relative longitudinal position of the inner element 1 and outer element 2.

By adjusting the relative longitudinal position of the inner element 1 and outer element 2, the fit between the inner surface 3 of the outer element 2 and the outer surface 4 of the inner element 1 may be made tighter or less tight. A clearance between the elements may be adjusted by adjusting the relative longitudinal position of the elements. It has been found that adjusting the relative longitudinal position of the elements may result in a significant change in the pressure achieved in the compressor 20 therefore a significant change in the heat generated by the compressor 20 in operation.

In some embodiments, the relative longitudinal position of the inner element 1 and outer element 2 is adjusted by adjusting the longitudinal position of bearings 24, 25, 26 and 28.

By adjusting the relative longitudinal position of the elements to achieve a tight fit, the chambers may be well sealed and a high pressure achieved. However, as the fit becomes tighter, the torque may increase due to mechanical losses. The temperature of the system increases due to pressure.

Therefore, it is important to control precisely the relative longitudinal position of the outer element 2 and inner element 1 for a particular application, to balance the pressure that may be achieved and the heat that is generated.

In further embodiments, the compressor may comprise any means for substantially fixing a longitudinal position of the inner element 1 along its axis of rotation 22 and for substantially fixing a longitudinal position of the outer element 3 along its axis of rotation 23, so as to substantially maintain a relative longitudinal positioning of the inner element and the outer element during rotation.

In some embodiments, the means for substantially fixing a longitudinal position of the inner element 1 and of the outer element 2 comprises a gearing arrangement comprising at least one gear.

For example, in one embodiment the inner element 1 is driven by a first gear 8. The first gear 8 is coupled to the shaft of a driving motor 14. The first gear 8 in turn drives a second gear 9 which is coupled with the outer element 9. The outer element 2 is fixed in a housing 6 by two bearings 24, 25, one at each end of the outer element 2. The compressor may further comprise an axial bearing 28 between the outer element 2 and inner element 1. Therefore, in this embodiment, the relative longitudinal position of the inner element 1 and outer element 2 is substantially maintained by a combination of gears and bearings.

The first gear 8 and second gear 9 may be as described above with reference to FIG. 1. In another embodiment, the inner element 1 and outer element 2 may be driven by an arrangement of gears 13, 16, 17 as described above with reference to FIG. 3. In further embodiments, any suitable gear arrangement may be used.

Elements of the different embodiments described herein may be combined in any appropriate manner. For example, an embodiment of a compressor may comprise one or more gears, for example as shown in FIG. 1 or 3, while also comprising one or more bearings, for example axial bearing 28 as shown in FIG. 6*a* or 7*a*. The housing 6 and covers 30, 31, 32 described with reference to FIG. 7*a* may be applied to the embodiment of FIG. 1 or FIG. 3.

It will be understood that the conical screw compressor of the described embodiments can be operated as a pump.

The conical screw compressor or pump of the above embodiments may be used for a variety of applications across many industries, for example in oil and gas offshore platforms, offshore carbon capture and storage, mining, submarines, ships and spacecraft.

It will be understood that the present invention has been described above purely by way of example, and that modifications of detail can be made within the scope of the invention.

Each feature disclosed in the description and (where appropriate) the claims and drawings may be provided independently or in any appropriate combination.

The invention claimed is:

1. A conical screw compressor or pump comprising:

an inner element configured to rotate around a first axis;

an outer element configured to rotate around a second axis; and a fixing mechanism that substantially fixes a longitudinal position of the inner element along the first axis and that substantially fixes a longitudinal position of the outer element along the second axis thereby substantially fixing the inner element and the outer element in a relative longitudinal position; wherein an outer surface of the inner element and an inner surface of the outer element comprise cooperating grooves and teeth that intermesh on rotation;

the first axis and the second axis are each stationary and the first axis is inclined relative to the second axis;

the conical screw compressor or pump further comprises a housing;

the fixing mechanism comprises a bearing proximate to a discharge end of the outer element and a further bearing proximate to a suction end of the outer element, wherein the bearing and the further bearing are each located between the outer element and the housing so as to allow relative axial rotation of the outer element and the housing while restricting longitudinal motion of the outer element and the housing;

the inner element is coupled to a shaft and the fixing mechanism further comprises at least one additional bearing between the shaft and the housing, the at least one additional bearing between the shaft and the housing being configured to allow relative axial rotation of the inner element and the housing while restricting relative longitudinal motion of the inner element and the housing.

2. A conical screw compressor or pump according to claim 1, wherein the fixing mechanism further comprises an axial bearing between a substantially end-facing surface of the inner element and the discharge side of the housing.

3. A conical screw compressor or pump according to claim 2, wherein the axial bearing is located between the discharge end of the inner element and the discharge side of the housing, and wherein the axial bearing is substantially aligned with the first axis of the inner element.

4. A conical screw compressor or pump according to claim 2, wherein an end of the inner element is stepped, and the substantially end-facing surface comprises a step surface of the inner element, the step surface facing the discharge end of the compressor or pump.

5. A conical screw compressor or pump according to claim 4, wherein the outer element comprises a surface proximate to the suction end of the outer element, and wherein one of the at least one additional bearing is disposed between the surface and the housing.

6. A conical screw compressor or pump according to claim 2, wherein the axial bearing is disposed between the substantially end-facing surface of the inner element and a surface of a recess in the housing.

7. A conical screw compressor or pump according to claim 1, wherein substantially fixing the longitudinal position of each of the inner element and the outer element comprises fixing the longitudinal position so that it varies by less than 3% of the length of the element, optionally less than 0.1% of the length of the element, further optionally less than 0.01% of the length of the element, further optionally less than 0.001% of the length of the element.

8. A conical screw compressor or pump according to claim 1, wherein at least one of the inner element and outer element is configured to be driven by a motor.

9. A conical screw compressor or pump according to claim 8, wherein either a) or b):

a) the inner element is configured to be driven by the motor, and the outer element is configured to be driven by the inner element;

b) the outer element is configured to be driven by the motor, and the inner element is configured to be driven by the outer element.

10. A conical screw compressor or pump according to claim 1, further comprising a further element at the suction end of the outer element, the further element being substantially aligned with the second axis of the outer element, wherein the further element comprises a mounting location for mounting one of the at least one additional bearing for the inner element, the mounting location being substantially aligned with the first axis of the inner element.

11. A conical screw compressor or pump according to claim 10, wherein the mounting location is radially offset from center point of the further element.

12. A conical screw compressor or pump according to claim 10, wherein the further element comprises a cover.

13. A conical screw compressor according to claim 12 wherein a central axis of the cover is aligned with the second axis of the outer element, and wherein a central axis of the mounting location is aligned with the first axis of the inner element.

14. A conical screw compressor or pump according to claim 10, wherein the further element is configured to maintain a substantially fixed angle between the first axis and the second axis.

15. A method of operating a conical screw compressor or pump, the conical screw compressor comprising:

an inner element configured to rotate around a first axis;

an outer element configured to rotate around a second axis, wherein:

an outer surface of the inner element and an inner surface of the outer element comprise cooperating grooves and teeth that intermesh on rotation;

the first axis and the second axis are each stationary and the first axis is inclined relative to the second axis; and the method comprising:

using a fixing mechanism to substantially fix a longitudinal position of the inner element along the first axis and to substantially fix a longitudinal position of the outer element along the second axis thereby to substantially fix the inner element and the outer element in a relative longitudinal position; and rotating the inner element and outer element, wherein the conical screw compressor or pump further comprises a housing;

the fixing mechanism comprises a bearing proximate to a discharge end of the outer element and a further bearing proximate to a suction end of the outer element, wherein the bearing and the further bearing are each located between the outer element and the housing so as to allow relative axial rotation of the outer element and the housing while restricting longitudinal motion of the outer element and the housing;

the inner element is coupled to a shaft and the fixing mechanism further comprises at least one additional bearing between the shaft and the housing, the at least one additional bearing between the shaft and the housing being configured to allow relative axial rotation of the inner element and the housing while restricting relative longitudinal motion of the inner element and the housing.

* * * * *